United States Patent [19]

Lezgintsev et al.

[11] 4,116,069

[45] Sep. 26, 1978

[54] DEVICE FOR TAKING BOTTOM SOIL SAMPLES FROM DEEP WATER BASINS

[76] Inventors: Georgy Mikhailovich Lezgintsev, Leninsky prospekt, 36, kv. 250; Stanislav Jurievich Istoshin, Koptevskaya ulitsa, 26, korpus 3, kv. 69; Mikhail Anatolievich Belyavsky, ulitsa Butlerova, 10, kv. 81; Evgeny Alexeevich Kontar, ulitsa Kropotkina, 9, kv. 2; Nikolai Nikolaevich Koptyazhin, Matveevskaya ulitsa, 36, korpus 2, kv. 145, all of Moscow; Georgy Ivanovich Agaltsov, ulitsa Yana-Shilfa Yaunzema, 5, kv. 3, Riga; Boris Serafimovich Chernov, ulitsa Zilupes, 22, kv. 97, Riga; Eduard Isaakovich Ter-Saakov, ulitsa Moskavas, 71, kv. 2, Riga; Evgeny Petrovich Shkatov, ulitsa Ordinarnaya, 20, kv. 14, Leningrad, all of U.S.S.R.

[21] Appl. No.: 705,915

[22] Filed: Jul. 16, 1976

[51] Int. Cl.[2] ..... G01N 1/00; E02F 3/44; B66C 3/02

[52] U.S. Cl. ..... 73/425.2; 37/71; 37/186

[58] Field of Search ..... 37/54, 56, 71, 183 R, 37/183 A, 184–188; 73/425.2, 425, 421 R; 175/6, 5; 61/69 R

[56] References Cited

U.S. PATENT DOCUMENTS

| | | | |
|---|---|---|---|
| 2,798,378 | 7/1957 | Del Raso et al. | 175/8 |
| 3,509,772 | 5/1970 | Blair | 73/425.2 |
| 3,572,129 | 3/1971 | Walthier et al. | 37/187 X |
| 3,996,678 | 12/1976 | Amann et al. | 37/183 R |

FOREIGN PATENT DOCUMENTS

| | | | |
|---|---|---|---|
| 2,336,800 | 2/1974 | Fed. Rep. of Germany | 37/71 |

*Primary Examiner*—Clifford D. Crowder
*Attorney, Agent, or Firm*—Lackenbach, Lilling & Siegel

[57] ABSTRACT

The device comprises two independently operating systems which are separated from each other in kinematical and actuating respects, viz, a system for closing the jaws of the sample-taking grab and a system for dropping the ballast weights. Said system for dropping the ballast weights is based on the principle of unstable fixing of the weights, the weights being detached from the sampling device after the leader rod strikes the bottom of the basin. Various embodiments of the grab-closing system incorporate, for example, a pulley block and cable mechanism intended first to close the grab jaws, and then to lift out the entire apparatus by taking up the free length of the cable.

3 Claims, 16 Drawing Figures

DEVICE FOR TAKING BOTTOM SOIL SAMPLES FROM DEEP WATER BASINS

The present invention relates to self-contained apparatuses intended to take samples of the upper layers of sedimentary deposits from the bottom of an ocean or other deep water basins.

Known in the previous art are self-contained samplers used in, for example, large-scale prospecting of deep-water deposits of iron manganese nodules on the ocean bottom. Such samplers are exemplified by free-falling grabs employed by the specialized vessel "Valdivia" (Federal Republic of Germany) carrying out prospecting work for concretions in the Pacific and Indian Oceans (see, for example, "Freefalling grabs for underwater work" in the collected papers "Express Information" "Underwater engineering, diving and ship-raising work," VNIIGI No. 43, 1973, pp. 27–19).

Being a prototype of the present invention, the self-contained samplers of the free-falling grab type consist of a frame with floats, droppable ballast weights, a retainer, a leader rod and a working element made in the form of grab jaws operated by a spring or a rubber cord.

According to the German experience gained by research workers and geologists, the use of free-falling samplers for exploration and prospecting of solid mineral deposits on the bottom of the ocean is highly effective (the efficiency of bottom exploration reaches 100–120 square miles a day); however, the design of these samplers has two basic disadvantages.

First, the weight of the lifted sample does not exceed 3–3.5 kg of concretions collected from a bottom area of not over 0.1 $m^2$. This is attributable to the use of springs and rubber cords for actuating the grab jaws; these springs and cords are capable of actuating only small jaws and, in addition, produce uneven forces within the working cycle.

Second, the known designs of self-contained samplers are not provided with devices for their emergency surfacing so that when incompletely closed jaws of the grab get stuck in clay or are caught by a boulder, the effect of the nondropped ballast is to cause the sampler to be lost. Thus, the "Valdivia" loses from 10 to 50% of the total number of samplers in a month.

Also known is an even more advanced design of self-contained samplers devised by a French industrial and research association KNEKCO (see, for example, accepted patent application No. 2.336.800, Cl.5b 45/00, 1973, Federal Republic of Germany).

Operation of this sampler is less hindered by the adverse effect of the irregularities of the oceanic bottom; still its design is also very involved and, like free-falling grabs, it fails to ensure reliable collection and lifting of samples heavier than 3–3.5 kg.

An object of the present invention is to provide a device for taking bottom soil samples from deep water basins which would increase the efficiency of exploration of the bottom in carrying out oceanographic and prospecting work, in preparation of construction projects and in geological prospecting processes.

Another object of the present invention is to provide a device for taking bottom soil samples from deep water basins which would be capable of lifting heavier samples than those lifted by the known devices of the same application.

Still another important object of the present invention is to provide a device for taking bottom soil samples from deep water basins which would incorporate a mechanism for emergency surfacing in case of, for instance, incomplete closing of the grab jaws, or for guaranteed dropping of the ballast weights from the sampler after it is lowered onto the bottom.

A further object of the present invention is also to provide a device for taking bottom soil samples from deep water basins which would be more reliable due to independent functioning of the systems for lifting the apparatus and for closing the jaws of its grab.

A still further object of the present invention is to provide a device for taking bottom soil samples from deep water basins wherein the above-mentioned advantages would be achieved in a comparatively simple, convenient and cheap design which does not call for the use of unique and costly units.

An object of the present invention is also to provide an economical device of the above-stated application wherein the nonrecoverable ballast weight would consist of any readily accessible bulk material.

These and other objects are achieved by providing a device for taking bottom soil samples from deep water basins which comprises a leader rod, which has a float at the top and a sampler at the bottom and which is made in the form of a grab with normally open jaws, and droppable free-suspended ballast weights whose mass is sufficient for lowering the device until the lower end of the leader rod strikes the bottom. Said device is characterized in that it includes two systems operating independently and separately from each other in kinematical and actuating respects, viz, a system for closing the grab jaws and a system for dropping the ballast weights. The system for dropping the ballast weight is constituted of a unit for unstable fixing of the weights coupled by a lock joint with the leader rod so that at the moment when said rod strikes the bottom, the weights are shifted by said joint to an unstable state and detached from the device.

Such an engineering solution increases the reliability of the device, namely it guarantees the emergency surfacing of the lowered apparatus irrespective of the operation of the sampling system.

According to another modification of the present invention, there is provided a device for taking soil samples characterized in that the ballast-dropping system includes cantilivered levers whose lower ends are connected with the hinged grab jaws. In the initial position said levers are normally directed upward and located close to the central leader rod with which they are connected by rigid links, which turn the cantilevered levers together with the grab jaws sharply sidewise from the leader rod when the latter strikes the bottom. The upper free ends of the levers are provided with open cutouts which accommodate the ballast weight holders and which are shaped so as to allow the weights to snap out of the cutouts at a minimum preset turning angle of the cantilevered levers.

The above engineering solution is one of the simplest designs of a lever-type dynamic device for guaranteed dropping of ballast weights when the leader rod strikes the basin bottom.

According to another modification of the present invention disclosure is made of a device characterized by that the leader rod of the device is axially loaded by springs, is located in a guide rod connected with a float, and has a shaped cam section interacting with a tripping lever retainer of said links, said retainer being located on the guide rod, said links holding the cantilevered levers in the initial position close to the leader rod.

The modification of the present invention considered above provides a convenient and effective linkage between the leader rod and the ballast-carrying levers.

According to another modification of the present invention disclosure is made of a device characterized by that each jaw of the grab, which is hinged to the lower part of the leader rod and held open by said links together with the rigidly fastened cantilevered lever, has a center of gravity which is eccentric relative to the swivelling center of turning so that upon releasing of the links the jaws close and turn under the force of gravity.

The above engineering solution is based on a kinematic layout which ensures automatic closing of the grab jaws as soon as they are disengaged from the leader rod, i.e., at the moment when the device strikes the ground.

According to a still further modification of the present invention disclosure is made of a device for taking bottom soil samples characterized by that said ballast-dropping system has shaped recesses made on the upper side of each grab jaw and forming sockets for free accommodation of the ballast weights. The ballast weights are made in the form of rolling elements and are normally held in the sockets when the grab jaws are open. The leader rod has a group of projections which interact with the ballast weights when the leader rod strikes an object, so that said rolling elements come freely out of said sockets.

The above modification of the present invention provides a convenient and compact design ensuring initial holding and guaranteed dropping of the ballast weights without the use of any additional load-carrying levers.

According to the present invention disclosure is also made of a device for taking soil samples which is characterized by that said ballast-dropping system comprises hopper-containers which are articulated at their lower point in a state of labile equilibrium and filled with ballast of a preset mass. In addition, there is a thrust lever system connected at one end with the axially movable leader rod and normally bearing at the other end against said hoppers for holding them in the initial position and for releasing them at the moment the leader rod strikes an object.

This engineering solution makes it possible to dispense with the manufacture of special ballast weights and allows the apparatus to be repeatedly and economically used for taking samples because the ballast in this design may be constituted by any easy-to-get bulk material such as pebbles, cobblestone, etc.

According to the next modification of the present invention disclosure is made of a soil-sampling device characterized by that said jaw-closing system, which is independent from said ballast-dropping system, includes a group of pulley blocks coupled at one end with the float and at the other end with the grab jaws and a lock retainer which normally links the float with the leader rod and disconnects them when said leader rod strikes an object.

This version of the invention provides a reliable system of pulley blocks which releases the float after the leader rod strikes the bottom and performs successively the following operations: first closing the grab jaws by means of the cables being tensioned by the rising float, then lifting out the entire device after the jaws close to a maximim and the entire free length of the cable is taken up.

In the following modification of the present invention disclosure is made of a device characterized by that said pulley blocks comprise pulleys fastened on the grab jaws and a cable chain running around said pulleys, one end of said chain being connected to the float while its other sections are brought to the hinged grab jaws for closing them when the float comes to the surface and the cable is released from said lock retainer.

Such a technical solution offers an optimum layout of cables in the above-mentioned system of pulley blocks.

In another version of the present invention disclosure is made of a device characterized by that said lock retainer comprises a group of radial spring-loaded pins interacting with a cam projection on the leader rod and normally connecting said leader rod with a movable sleeve which holds the float via the pulley block cable.

Finally, the above modification of the present invention provides a reliable design of the tripping lock joint between the leader rod and the float via the pulley block cables.

Now the present invention will be described in detail by way of example with reference to the accompanying drawings in which.

According to the first embodiment of the present invention the device comprises a working element made in the form of jaws of a grab 1 (FIGS. 1, 2, 3, 4) with cantilevered levers 2 whose free ends in the form of forks 4 carry grips for supporting droppable ballast weights 3. A characteristic feature of the device consists in its systems which operate independently and are separated from each other in both the kinematical and the actuating respects.

The device comprises a system for closing the jaws of the grab 1 and a system for dropping the ballast weights 3, the system for dropping the ballast weights 3 being, essentially, a unit for unstable fastening of the weights 3.

Figure 1:
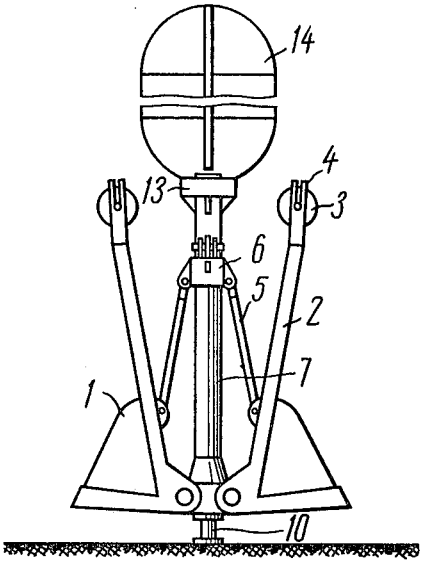
FIG. 1 is a general, elevational view of the device for taking bottom soil samples from deep water basins with cantilevered levers during submersion and upon reaching the bottom.
Figure 2:
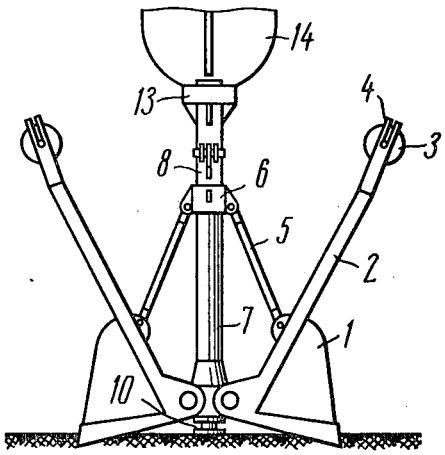
FIG. 2 is the same view of the same device during the initial sample-taking stage.
Figure 3:
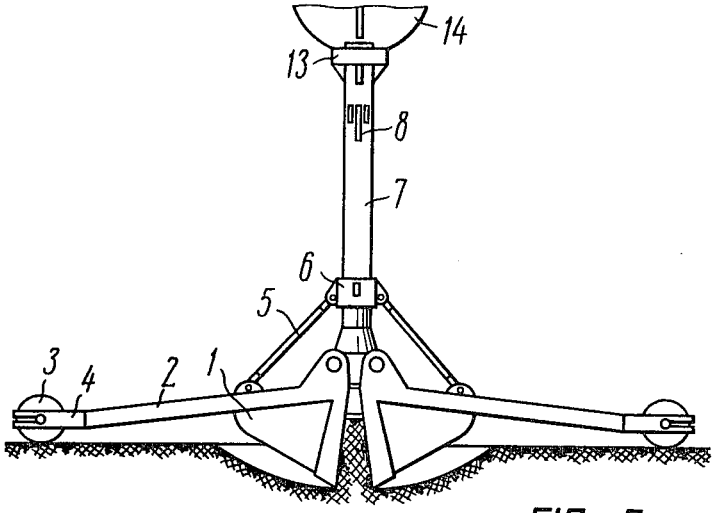
FIG. 3 is the same view of the same device during the final sample-taking stage.
Figure 4:
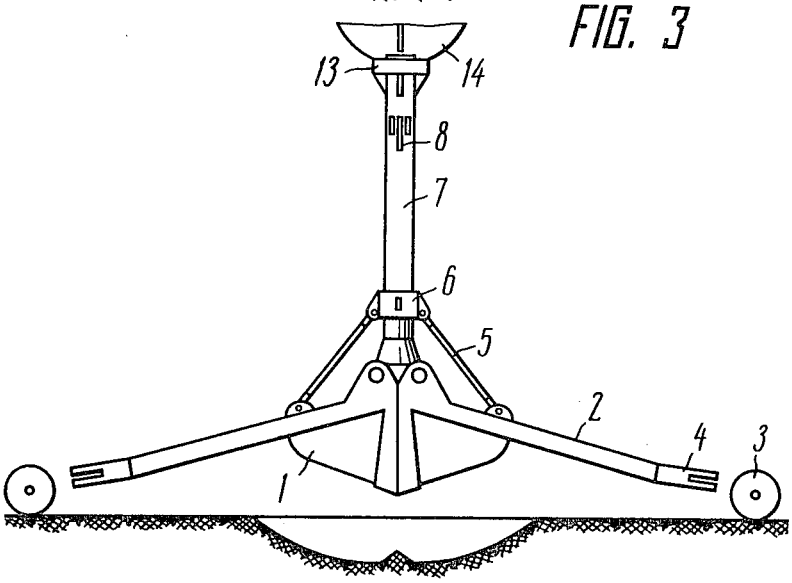
FIG. 4 is the same view of the same device when it is breaking off from the bottom and surfacing.
Figure 5:
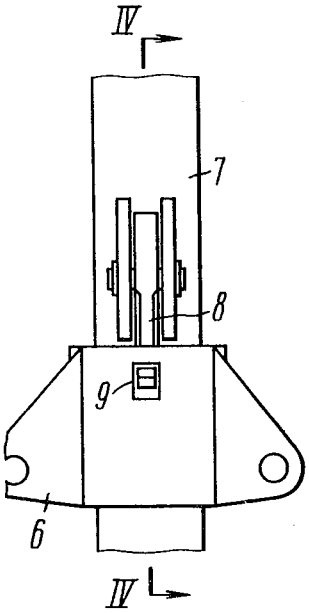
FIG. 5 is a general, elevational view of the lock retainer of the device for taking bottom soil samples from deep water basins.
Figure 6:
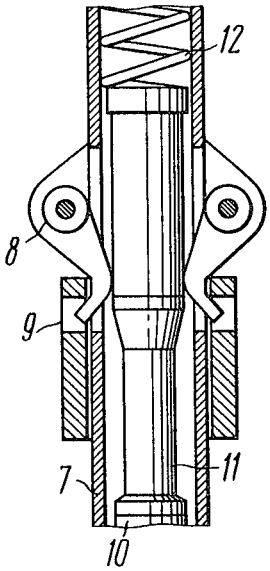
FIG. 6 is a cross sectional view taken along line VI—VI in FIG. 5.
Figure 7:
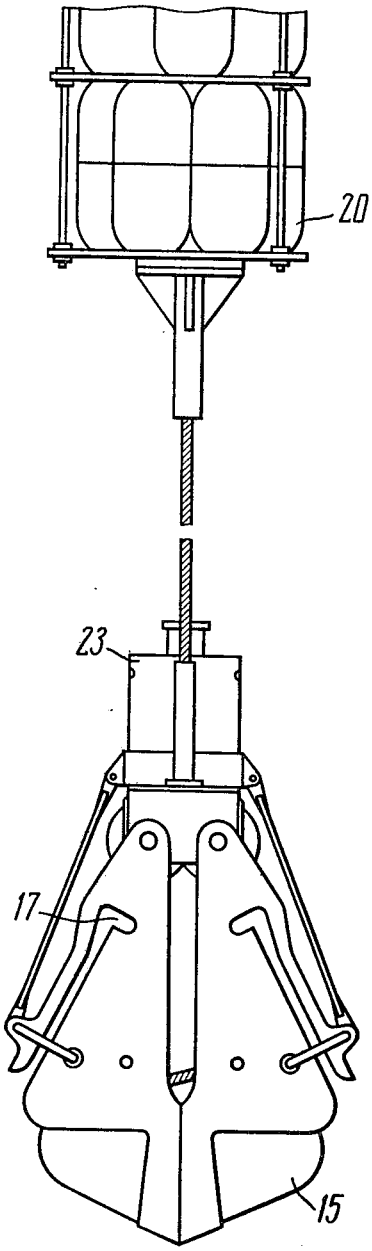
FIG. 7 is a general, elevational view of the device for taking bottom soil samples from deep water basins incorporating a pulley block system with the grab jaws closed.
Figure 8:
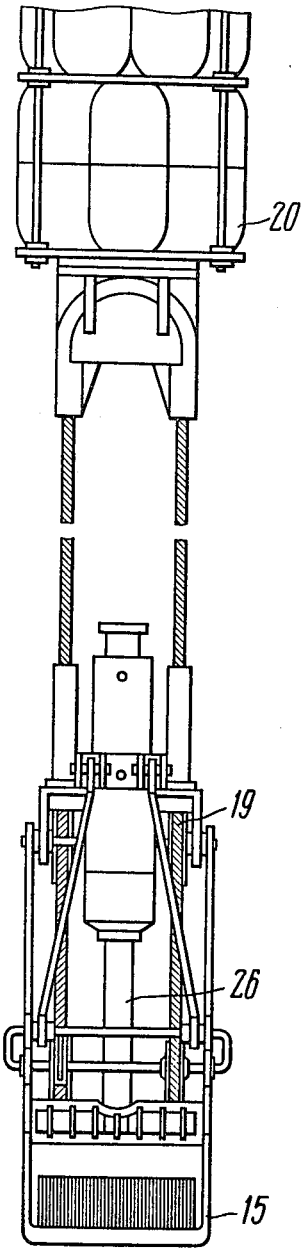
FIG. 8 is a side view of the device in FIG. 7.
Figure 9:
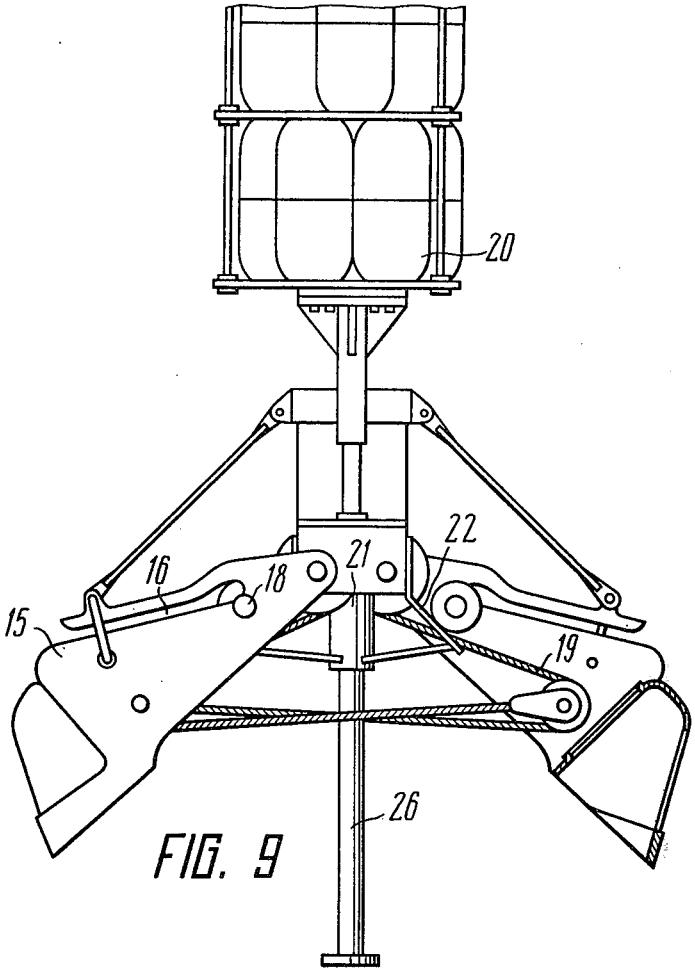
FIG. 9 is a view similar to FIG. 7, but with the grab jaws open.
Figure 10:
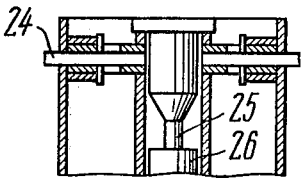
FIG. 10 is a general view by a sectionalized lock-retainer of the device for taking bottom soil samples from deep water basins.
Figure 11:
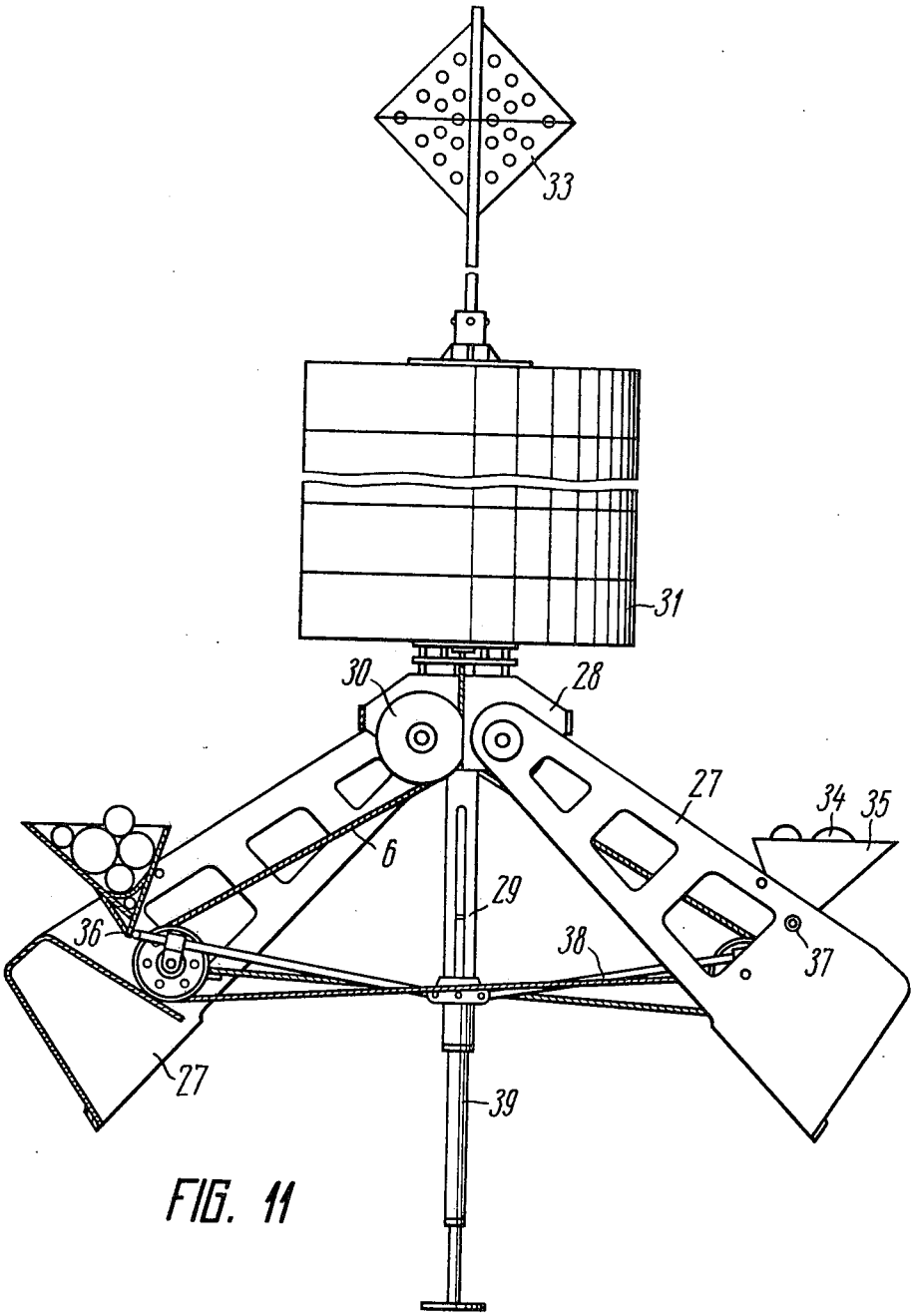
FIG. 11 is a general view of the device for taking bottom soil samples from deep water basins with hopper-containers and with the grab jaws open.
Figure 12:
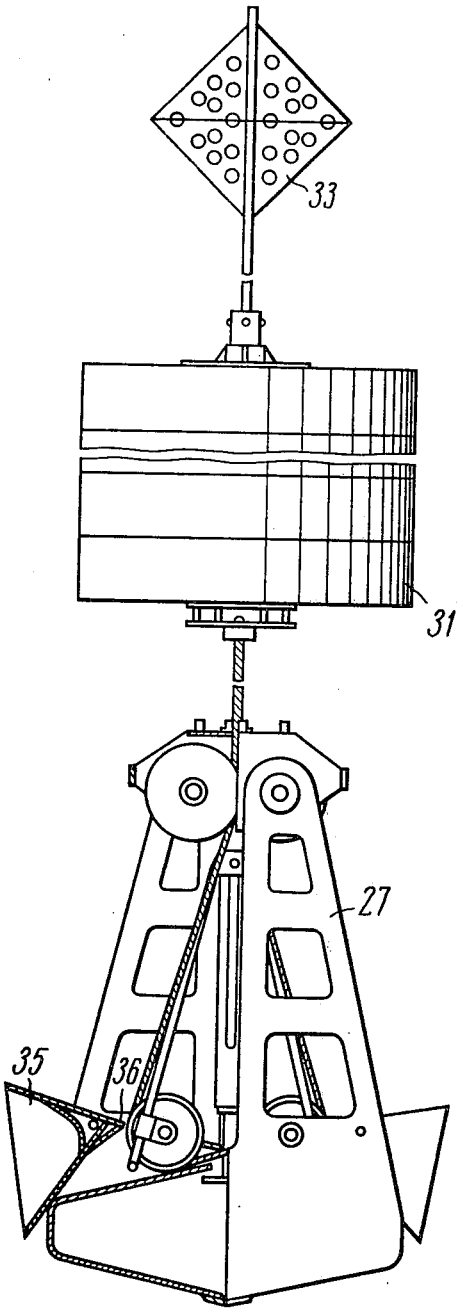
FIG. 12 is a view similar to FIG. 11, but with the grab jaws closed.
Figure 13:
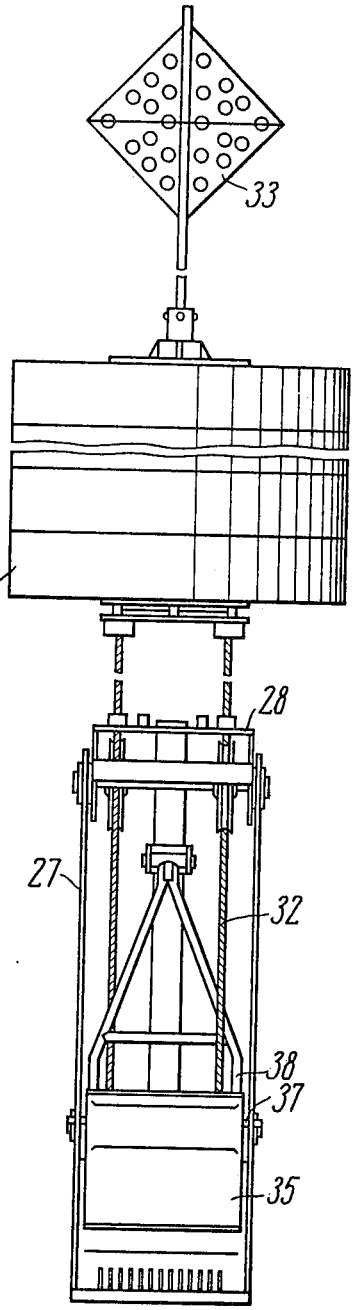
FIG. 13 is a side view of the device of FIGS. 11 and 12.
Figure 14:
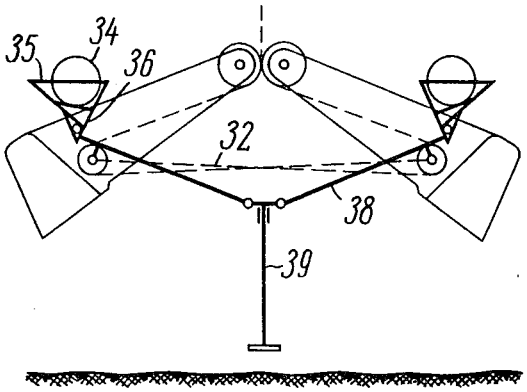
FIG. 14 shows the kinematic diagram of the lock-retainer of the device for taking bottom soil samples from deep water basins during submersion of the apparatus.
Figure 15:
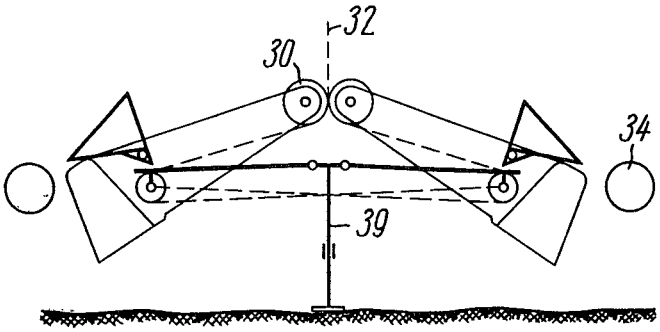
FIG. 15 is a similar diagram at the moment of striking the bottom.
Figure 16:
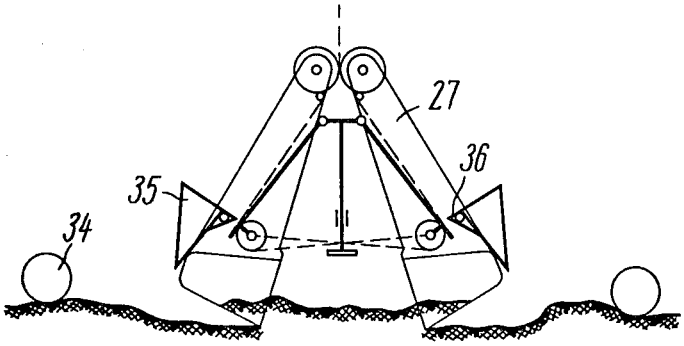
FIG. 16 is a similar diagram after taking the sample and before surfacing.

The jaws of the grab 1 are provided with links 5 articulated at one end to the jaw of the grab 1 and articulated at their other ends to a sleeve 6. The sleeve 6 is mounted for sliding along a guide rod 7 and for interacting with a retainer. The retainer consists of L-shaped levers 8 (FIGS. 5, 6) articulated to the rod 7 and which have their free ends positioned in the sleeve 6 by means of locking holes 9 located on the sleeve 6. The L-shaped levers 8 are capable of interacting with a profiled section 11 of the leader rod 10 which moves along the rod 7 and is loaded by spring 12. The upper portion of the device is provided with a float 14 secured by a flange joint 13.

As the device is launched from the carrier craft, its negative buoyancy created by the droppable ballast weights 3 causes the device to submerge at an average speed of about 1.2–1.5 m/s until it strikes the bottom of the ocean or deep water basin. Upon striking the bottom, the leader rod 10 travels up inside the rod 7, thus causing its profiled section 11 to contact the L-shaped levers 8 of the retainer; as a result, the retainer operates and the levers 8 release the locking holes 9 of the sleeve 6.

The cantilever levers 2 in the initial position are directed upward and are located close to the central leader rod 10 with which they are connected by rigid links 5. As the leader rod 10 strikes the bottom, said links turn the cantilever levers 2 together with the jaws of the grab 1 sidewise from leader rod 10. The upper free ends of the levers 2 have open cutouts accommodating holders of the ballast weights 3, the shape of said holders allowing said weights 3 to fall out of the cutouts at a minimum preset turning angle of the levers 2.

Inasmuch as the center of gravity of the grab jaws is eccentric relative to the hinge, said jaws together with the cantilever levers 2 and droppable weights 3 are turned by the forces of inertia, thus cutting and grabbing a layer of bottom soil. When the cantilever levers 2 come to a horizontal position or are slightly inclined downward, the centrifugal force automatically discharges the ballast weights 3 from the fork-shaped grips 4. After dropping the ballast weights the device with the float 14 acquires a positive buoyancy, brings the sample up to the surface and is picked up by the carrier craft.

According to another embodiment of the invention the sampling device consists of a working element made in the form of jaws of a grab 15 (FIGS. 7–10) with shaped cutouts 16 and sockets 17 which accommodate droppable ballast weights 18. Fixed between the jaws 15 are flexible links 19 whose outer ends are mounted on the float 20. The guide rod 21 below the sockets 17 for the droppable weights 18 has stops 22 mounted interacting with the droppable weights 18 during closing of the jaws of the grab 15. The retainer 23 holding the jaws of the grab 15 in the open position is made in the form of spring-loaded pins 24 installed so that they can interact with a shaped cam section 25 of the leader rod 26.

Thus, in the second embodiment of the invention, the ballast-dropping system includes shaped recesses made on the upper side of each jaw of the grab 15 and forming sockets 17 for free accommodation of ballast weights 18 made in the form of rolling elements. The ballast weights are held in the sockets 17 when the grab jaws are open and roll freely out of said sockets 17 when the end of the leader rod 26 strikes an obstacle.

The above-described device functions as follows. After the device has been launched from the carrier craft, its negative buoyancy created by the droppable ballast weights 18 causes it to submerge at an average speed of about 1.2–1.5 m/s until it reaches the bottom of the ocean or deep water basin. On striking the bottom, the leader rod 26 rises inside the guide rod 21 and its shaped section 25 which contacts the spring-loaded pins 24 releases the jaws of the grab 15. The jaws start closing and cut the sedimentary deposits under the effect of the Archimedean force built up by the floats 20 and transmitted by the flexible links 19. On closing of the jaws of the grab 15 the stops 22 push the droppable weights 18 out of the sockets 17. After taking the soil sample and after closing of the jaws of the grab 15, the device acquires a positive buoyancy due to the lifting force of the float 20 and the dropping of the ballast weights 18, rises to the surface of water and is picked up by the carrier craft.

According to the third embodiment of the present invention, the sampling device consists of a working element in the form of jaws of a grab 27 (FIGS. 11–16) fixed on a frame 28 with a supporting rod 29, and pulleys 30 with a cable reeved and connected with the float 31. The upper part of the float is provided with a device 33 for searching and spotting the surfaced sampler in the form of, for instance, a passive reflector.

To accommodate ballast weights 34 of any shape and profile, the sampling device is provided with hopper-containers 35 which have cantilever stops 36. The containers 35 are fixed on the jaws of the grab 27 with the aid of horizontal axles 37. The locking device of the sampler is, essentially, a mechanism for synchronizing the operation of the jaws of the grab 27 and dropping the ballast weights 34, said mechanism consisting of synchronizing rods 38 articulating the leader rod 39 with the jaws of the grab 27. The synchronizing rods 38 are installed so as to ensure self-fixing of the grab jaws in the wide open position.

Said system for dropping the ballast weights 34 comprises hopper-containers 35 articulated at the lower points in the state of labile equilibrium and filled with ballast of a preset mass, and has a system of thrust levers connected at one end with an auxially-movable leader rod 39 and having their other ends normally bear against said hoppers-containers 35 for holding them in the initial position and for releasing them at the moment when the leader rod 39 strikes an obstacle.

The sampling device operates as follows.

Before the sampling device is launched from the carrier craft the jaws of the grab 27 are completely opened and fixed in this position by the synchronizing rods 38. Due to the interaction of the synchronizing rods 38 with the cantilevered stops 36 the locking device fixes the containers 35 in the raised position after which they are filled with the required number of ballast weights 8.

As the sampling device strikes the bottom the leader rod 39 travels up and releases the locking device due to the rising of the synchronizing rods 38 which articulate the leader rod 39 with the jaws of the grab 27.

While rising, the synchronizing rods 38 interact with the cantilevered stops 36 thus turning the containers around the horizontal axles 37, overturning them and discharging the ballast weights 34. The released jaws of the grab 27 start closing and scrape off the sedimentary deposits from the bottom of the ocean. The jaws of the grab 27 are closed by the Archimedean force created by the released float 31 and transmitted by flexible links made in the form of pulley block cable 32 received on the pulleys 30. Full closing of the jaws of the grab 27 completes the sampling cycle and the sampler acquiring positive buoyancy with the aid of the float 31, comes to the surface of the ocean, is spotted by means of, for instance, radar and the passive reflector 33 and is placed on board the carrier craft.

What is claimed is:

1. A device for taking bottom soil samples from deep water basin comprising: a frame, a leader rod accommodated in said frame and provided with a float at the top; a sampling element located at the lower part of said leader rod and made in the form of a grab with normally open jaws; ballast weights removably suspended from said frame and weighing enough to lower the device in the water of the basin until the lower end of said leader rod strikes the bottom of the basin; means for closing the grab jaws; means for removing the ballast weights from said frame when said leader rod strikes the bottom of the basin; wherein said means for removing includes a mechanical lock joint, which connects said weights with the leader rod so that when said leader rod strikes the bottom said lock joint shifts the weights to an unstable state and they are removed from the frame, containers which are articulated at lower points on the jaws of the grab in a state of labile equilibrium and are filled with the ballast weights of a preset mass, and a system of levers, said levers having one end connected with said leader rod and the other end bearing against said containers for holding them in an initial position and for releasing them at the moment when the leader rod strikes an obstacle, said leader rod being movable in an axial direction.

2. A device for taking soil samples according to claim 1 wherein said means for closing the grab jaws incorporates a group of pulley blocks connected at one end with the float and connected at the other end with the grab jaws and with a lock retainer which normally holds the containers in equilibrium and upsets the containers when the leader rod strikes an obstacle.

3. A device according to claim 2 wherein said pulley blocks comprise pulleys fixed on the grab jaws and a cable chain running over said pulleys, one end of said chain being connected to the float and the other chain sections being brought to the hinged grab jaws for closing them while the float comes to the surface and the cable is released from said lock retainer.

* * * * *